United States Patent [19]

Zdanys et al.

[11] 3,944,760

[45] Mar. 16, 1976

[54] SWITCH ASSEMBLY HAVING SLIDER ACTUATOR INSULATING PLATE INSERTED BETWEEN NORMALLY CLOSED CONTACTS

[75] Inventors: John Zdanys, Edwardsburg; William L. Kelver, Jr., Cassopolis, both of Mich.

[73] Assignee: CTS Corporation, Elkhart, Ind.

[22] Filed: Apr. 8, 1974

[21] Appl. No.: 458,505

[52] U.S. Cl. ..... 200/6 BB; 200/16 R; 200/153 M; 200/303

[51] Int. Cl.[2] ..... H01H 15/02; H01H 27/04

[58] Field of Search ..... 200/6 B–6 BB, 200/6 R, 16 R, 61.19, 149, 151, 153 M, 159 R, 303, 293–296, 283, 284

[56] References Cited

UNITED STATES PATENTS

| | | | |
|---|---|---|---|
| 1,575,469 | 3/1926 | Waterbury | 200/153 M UX |
| 2,172,396 | 9/1939 | Meuer | 200/6 BB |
| 2,254,347 | 9/1941 | Blakesley | 200/61.19 UX |
| 2,807,683 | 9/1957 | Bettencourt | 200/6 BB X |
| 2,868,930 | 1/1959 | Pistey et al. | 200/6 BB X |
| 2,900,460 | 8/1959 | Wallace | 200/6 BB |
| 3,311,725 | 3/1967 | Butler et al. | 200/61.19 X |
| 3,361,888 | 1/1968 | Brackett | 200/153 M X |
| 3,624,320 | 11/1971 | Eberhart et al. | 200/303 X |
| 3,740,501 | 6/1973 | Kiessling et al. | 200/16 R |

*Primary Examiner*—James R. Scott

[57] ABSTRACT

A switch assembly provides a plurality of slide switches. Each switch employs a flexible guide rod cantilevered within a common housing providing a first contact. A second contact is biased into electrical contact with each guide rod and an insulative cam carried by a switch actuator is supported by each guide rod for rectilinear movement therealong in an interference path with the second contact to separate the second contact from the guide rod. The flexible guide rod is movable with respect to the second contact and provides the means to align the switch actuator and the cam in an interference path with the second contact. Each switch actuator provides a pair of side walls enclosing a respective guide rod and second contact suspended therebetween.

13 Claims, 6 Drawing Figures

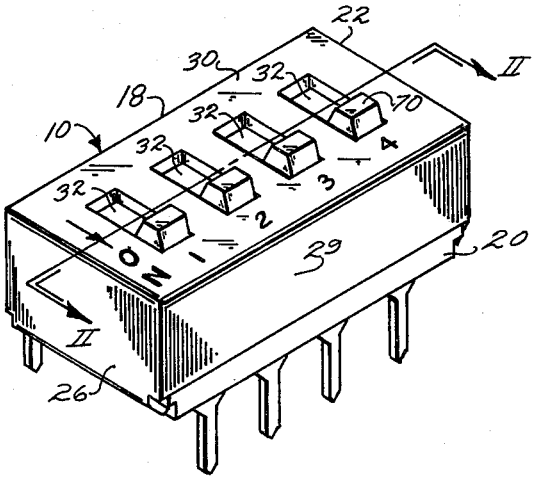
FIGURE-1
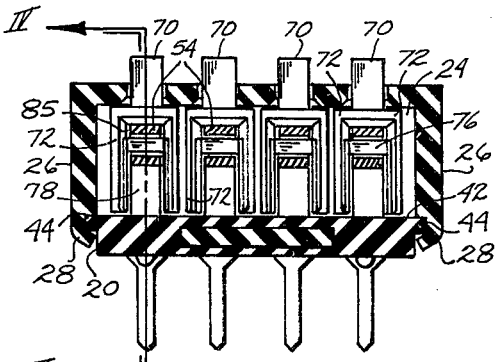
FIGURE-2
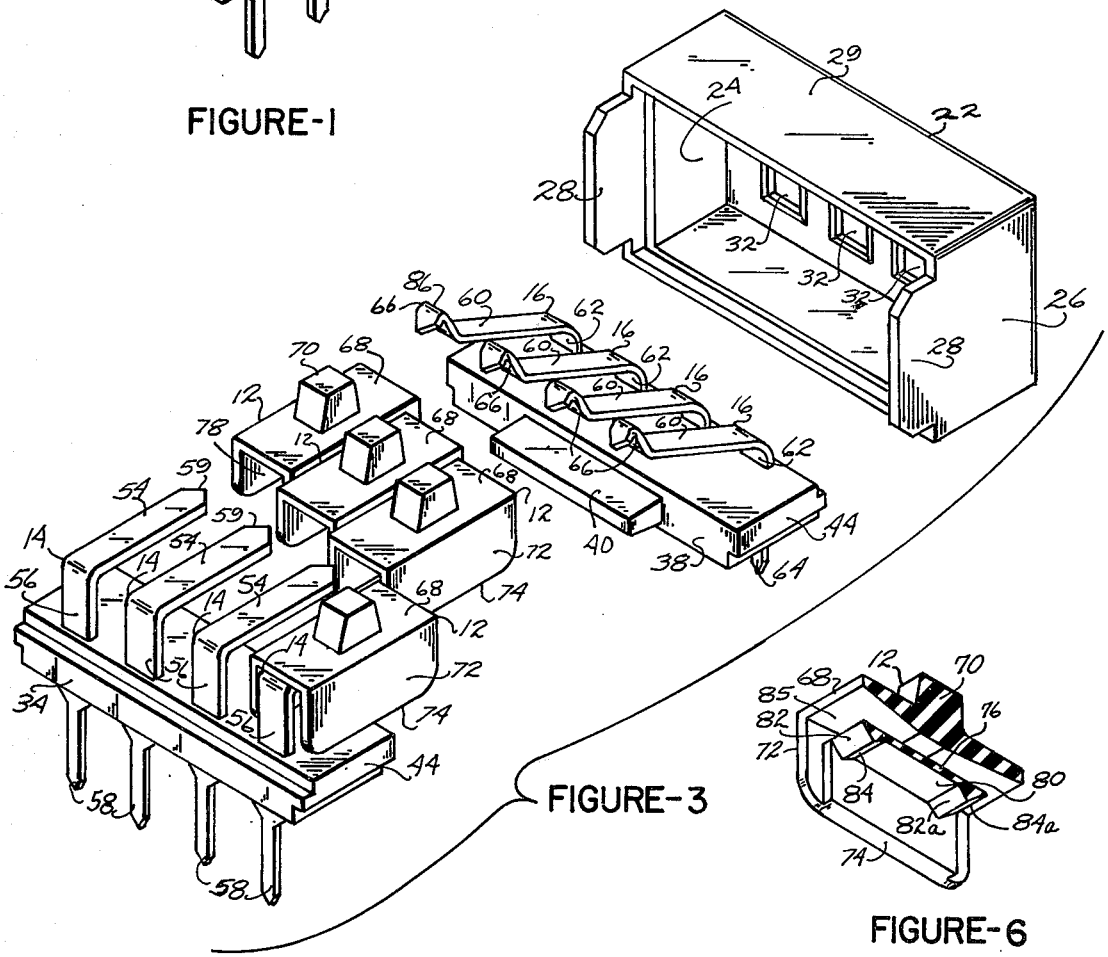
FIGURE-3
FIGURE-6
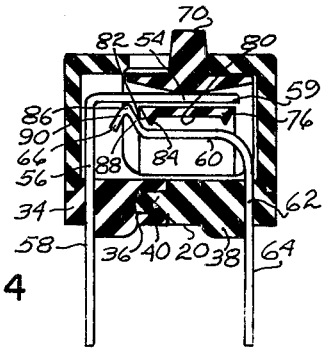
FIGURE-4
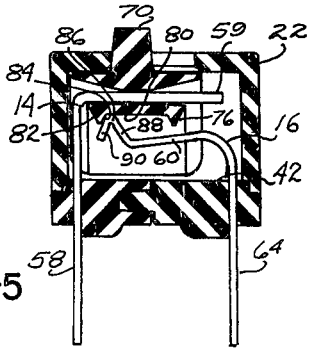
FIGURE-5

SWITCH ASSEMBLY HAVING SLIDER ACTUATOR INSULATING PLATE INSERTED BETWEEN NORMALLY CLOSED CONTACTS

This invention relates generally to electrical switches and more particularly to a switch assembly employing a plurality of slide switches.

Switches employing a sliding member or actuator to electrically connect or disconnect a pair of contacts are generally referred to as slide switches. Such a switch is shown in U.S. Pat. Nos. 3,493,706 and 3,524,028. Slide switches are generally provided with a housing channel or a rail secured to the housing to support and align the actuator for rectilinear movement along the rail or channel relative to the contacts. For suitable engagement of switch actuator with the contacts, the rail or channel must be aligned with respect to the contacts. Even though the rail, for example, is usually rigidly fixed, movement of the rail with respect to the contacts is generally not critical to align the actuator with respect to the contacts because of the size of the components involved. However, as the need increases for switch assemblies of relatively decreasing size, each assembly employing a plurality of switches, such as in computers and telephone exchanges, and the size of the components therefore decreases, the alignment of the component parts becomes more significant. It would therefore be desirable to provide a slide switch employing a flexible, cantilevered guide rod for slidingly supporting a switch actuator and movable with respect to the switch contacts.

In slide switches employing a rail to support the actuator, the rail often provides a first terminal of the switch and the actuator sliding along the rail carries a contactor electrically connecting the rail to a second contact or terminal. In other instances, the rail does not provide an electrical connection and the actuator simply acts as a camming member electrically connecting or disconnecting a pair of contacts. In either case, the rail or the contactor carried by the actuator constitutes an additional or fourth component in the switch device since a switching action can be provided simply by a pair of contacts and an actuator. In the fabrication of switches particularly requiring high volume mass production techniques, it is always desirable to reduce the number of component parts in the switch and simplify the assembly procedure. It would therefore be desirable to eliminate the need for an additional contact in a slide switch employing a rail by biasing a first contact into engagement with a rail providing a second contact and wherein a switch actuator slidably supported on the rail disengages the first contact from the guide rod.

Many applications in digital data transmission require a switch assembly providing a plurality of switches. Each switch in the switch assembly is preset to an open or closed position and a plurality of the switches represent a predetermined binary digit. Such a switch is shown in U.S. Pat. No. 3,792,206. A malfunction in any one of the plurality of switches can subvert the entire switch assembly. It is therefore important with this type of switch assembly to prevent malfunction in any one of the plurality of switches comprising the assembly. Malfunction is often caused by solder and flux particles interfering with the engagement of the switch contacts. Specifically, in cases where such a switch assembly is mounted on a printed circuit board, the terminals extending from the base of the switch assembly are partially dipped in molten solder for connecting the terminals into a circuit, thus exposing the contacts of the switch assembly to flux and solder particles. In such a switch assembly, foreign particles though not causing a malfunction with one set of contacts can drift into engagement with an adjacent set of switch contacts and cause a malfunction. One method of preventing the drift of foreign particles between adjacent sets of switch contacts is to provide a housing with integral barriers forming compartments for each set of switch contacts. With this method, however, in addition to requiring a plurality of housing barriers forming the compartments, each set of switch contacts and each switch actuator must be aligned within each respective compartment. Another method of providing barriers between adjacent sets of switch contacts is to provide each of the switch actuators with side walls. In most instances, however, wherein switch actuators are provided with side walls, the switch contacts are disposed outside of or near the bottom edges of the side walls minimizing the effectiveness of the side walls as barriers. It would therefore be desirable to eliminate the need for individual housing compartments in a switch assembly to prevent foreign particle drift between adjacent sets of switch contacts by providing a plurality of switch actuators having pairs of side walls enclosing switch contacts suspended therebetween.

Accordingly, it is an object of the present invention to provide a new and improved switch assembly having the various desirable features set forth above.

Still another object of the present invention is to provide a new and improved slide switch employing a flexible guide rod cantilevered within a housing for slidingly supporting a switch actuator.

Another object of the present invention is to join first and second base sections of a switch assembly having opposed embedded contacts to align and bias the opposed contacts into electrical engagement.

Another object of the present invention is to provide a new and improved slide switch wherein a first contact is biased into engagement with a guide rod providing a second contact and wherein an insulative cam is slidably supported by the guide rod to disengage the first contact from the guide rod.

Another object of the present invention is to provide a flexible guide rod suspended within a housing for supporting a switch actuator and movable with respect to a switch contact for aligning the switch actuator with respect to the switch contact.

A further object of the present invention is to provide a new and improved switch assembly employing a plurality of switch actuators having depending side walls enclosing sets of switch contacts suspended therebetween.

Further objects and advantages of the present invention will become apparent as the following description proceeds and the features of novelty characterizing the invention will be pointed out with particularity in the claims annexed to and forming a part of this specification.

Briefly, the present invention is concerned with a switch assembly providing a plurality of switches. Each switch employs a flexible guide rod, a contact element biased into engagement with the guide rod, a movable contact arm integral with the contact element and a switch actuator slidably supported by the guide rod for separating the guide rod and the contact element. The guide rods are cantilevered within a cavity formed by a cover and first and second base sections and the movable contact arms are suspended within the cavity in underlying relationship with the guide rods. A terminal integral with each of the guide rods and extending perpendicular therefrom is embedded in the first base section and a terminal integral with each of the movable contact arms extending perpendicular therefrom is embedded in the second base section. Each switch actuator is provided with a pair of side walls enclosing a respective guide rod and movable contact arm suspended therebetween. A cam interconnected between the side walls defines an opening for receiving a respective one of the guide rods. Upon a predetermined movement of the switch actuator along the guide rod, the cam is slidingly interposed between the guide rod and the contact element and the flexible guide rod provides the means to align the cam in an interference path with the contact element.

For a better understanding of the present invention, reference may be had to the accompanying drawings wherein the same reference numerals have been applied to like parts and wherein:

FIG. 1 is an isometric view of an electrical switch assembly embodying the present invention;

FIG. 2 is a sectional view taken along lines II—II of FIG. 1;

FIG. 3 is an exploded view of the assembly shown in FIG. 1;

FIGS. 4 and 5 are sectional views to illustrate the relative positions of the switch in the open and closed positions taken along lines IV—IV of FIG. 2; and FIG. 6 is a detail of the switch actuator.

Referring now to the drawings, an electrical switch assembly is generally indicated at 10 comprising a plurality of switch actuators 12, a plurality of spaced first contacts 14, a plurality of spaced second contacts 16 and a housing 18 having a base 20 and a cover 22 molded of suitable dielectric material and defining an elongated cavity 24. The cover 22 is provided with a pair of end walls 26 having extensions 28, a pair of sides 29 and a top 30 provided with a plurality of slots 32. The base 20 comprises a first section 34 having a side with an elongated key seat 36 and a second section 38 having a side with an elongated key 40. The elongated key 40 in the first section 34 interfits with the key seat 36 in the second section 38 to secure the first and second base sections together providing a base 20 with top surface 42 and shoulders 44. The extensions 28 of the end walls 26 of the cover 22 are heat swaged to the underside of the shoulders 44 to secure the cover 22 to the base 20. Embedded in a portion of the first base section 24 are the spaced first contacts 14 and embedded in a portion of the second base section 38 are the spaced second contacts 16. Preferably, portions of a blank strip of metal are embedded in the base sections at the time of molding, the blank metal strip then being punched and formed to provide the first and second contacts.

Each of the first contacts 14 are preferably of gold plated brass wire and comprise a flexible guide rod 54 elevated above the top surface 42 of the base 20, a first intermediate section 56 integral with the guide rod 54 and embedded in the first base section 34, and a first terminal section 58 integral with the first intermediate section 56 and extending outwardly from the base for providing a connection to an electrical circuit. Preferably, the flexible guide rods 54 are laterally and uniformly cantilevered within the cavity 24 having a free end 59 disposed therein and the first intermediate sections 56 are disposed along the side of the cover 22 perpendicular to the guide rods 54. Each of the second contacts 16 are preferably of gold plated brass wire and comprise a movable contact arm 60 also elevated above the top surface 42 of the base 20, a second intermediate section 62 integral with the movable contact arm 60 and embedded in the second base section 38, and a second terminal section 64 integral with the second intermediate section 62 and extending outwardly from the base for providing a connection to an electrical circuit. Preferably, the movable contact arms 60 are laterally and uniformly suspended within the cavity 24 and the second intermediate sections 62 are disposed along the side of the cover perpendicular to the movable contact arms 60. Integral with each of the movable contact arms 60 is a U-shaped contact element 66. Preferably, the joining of the first and second base sections 34 and 38 with embedded contacts 14 and 16 to form the base 20, positions a first intermediate section 56 opposite a second intermediate section 62 and aligns each of the guide rods 54 in overlying relationship with a respective movable contact arm 60. The spring tension of the movable contact arm 60 biases each of the U-shaped contact elements 66 into contact with the underside of a respective guide rod as seen in FIG. 4. Each of the guide rods 54 and movable contact arms 60 form identical contact pairs. As shown in FIG. 3, there are four contact pairs, it being understood that the number of contact pairs can be varied by merely changing the number of contacts 14 and 16 embedded in each base section to vary the number of individual switches in the switch assembly.

In accord with the present invention slidably engaging each of the guide rods 54 is a switch actuator 12 for selectively opening and closing each U-shaped contact element 66 with respect to a respective guide rod 54. Each switch actuator 12 comprises a top or bight section 68, and operating knob 70 projecting from the bight section 68, a pair of spaced parallel side walls 72 with bottom edges 74 depending from either side of the bight section 68 and an insulative cam 76 secured between the side walls 72. The bight section 68 and the depending side walls 72 define a compartment 78 as seen in FIGS. 2 and 3 for receiving a respective contact pair. Each of the operating knobs 70 extends through a respective slot 32 in the cover 22 for actuation of the operating knob by an operator and the movement of the operating knob 70 is limited in either direction by the knob abutting one of the respective ends of the slot 32. The insulative cam 76 is an elongated bar extending between the side walls 72 and is provided with a bottom surface or indentation 80 and two pairs of camming surfaces 82, 84 and **82*a*, 84*a*. The cam 76 is spaced from the bight section 68 of the switch actuator and together with the bight section 68 and side walls 72 defines an aperture 85 as seen in FIGS. 2 and 6 for receiving a respective one of the guide rods 54. As seen in FIGS. 2 and 3, the side walls 72 straddle the guide rod 54 with the top of the guide rod engaging the bight section 68 for supporting the switch actuator 12 for rectilinear movement along the guide rod 54. The first and second intermediate sections 56 and 62 elevate the movable contact arms 60 and guide rods 54 for suspension between the side walls 72 of a respective switch actuator 12. Each pair of side walls 72 therefore provides longitudinal barriers within the cavity 24 between respective contact pairs for blocking the passage of foreign particles. It should be understood that elevating the contact pairs above the top surface 42** of the base prevents the interference with the contact pairs by foreign particles settling on the base.

Each of the U-shaped contact elements 66 comprises an apex 86 and legs 88 and 90 as seen in FIGS. 4 and 5 and is selectively switched from a closed position to an open position by the switch actuator 12 slidably traversing the guide rod 54 interposing the cam 76 between the guide rod and the contact element 66. Two identical pairs of camming surfaces 82, 84 and 82*a*, 84*a* are provided with the cam 76 to facilitate the insertion of either side of the switch actuator 12 onto the guide rod 54. However, only one pair of camming surfaces is required in the operation of each respective switch. With references to FIG. 4, the suspension of the switch actuator 12 on the guide rod 54 aligns the first camming surface 82 in an interference path with the U-shaped contact element 66. It should be understood that the flexible guide rod 54 having a freely suspended end 59 could be flexed within the cavity 24 to align the switch actuator 12 and cam 76 with respect to the U-shaped contact element 66. In the closed position, as seen in FIG. 4, the apex 86 and the U-shaped contact element 66 is biased into contact with the guide rod 54. Although the movable contact arm 60 biases the guide rod 54 upward, the bight section 68 of the switch actuator 12 bearing on the top 30 of the cover 22 maintains the guide rod 54 in a parallel relationship with the base 20. As the switch actuator 12 is moved to the left, the camming surface 82 engages leg 88 of the U-shaped contact element 66 and further movement of the switch actuator 12 drives the cam 76 up over the apex 86 of the U-shaped contact element 66 to a point where the second camming surface 84 engages the leg 90 of the contact element 66 to open the switch as seen in FIG. 5. It should be understood that the U-shaped contact element 66 acts as a detent engaging the indentation 80 in the cam 76 and locking the second camming surface 84 against the leg 90 of the U-shaped contact element 66.

If insufficient force is exerted on the switch actuator 12 to drive the U-shaped contact element 66 or detent over the apex 86 the engagement of the first camming surface 82 with the first leg 88 of the contact member together with the upward bias of the movable contact arm 60 will spring the cam 76 further to the right freely out of engagement with the contact element 66. To close the switch from the open position, the cam is moved to the right over the apex 86 of the contact element 66 with the second camming surface 84 engaging the second leg 90 of the movable contact arm 60 moving the contact element 66 into contact with the guide rod 54. The movement of the cam 76 between the guide rod 54 and contact element 66 and the withdrawal of the cam 76 provides a self-cleaning or wiping action to eliminate the occurrence of foreign particles between the contact element 66 and the guide rod 54.

From the foregoing description, it is clear that the above control device can be easily assembled. A metal blank strip is provided with suitable slots and suitable base sections are molded integral with the blank strip embedding portions of the blank strip in the base sections. The blank is then stamped and formed to provide suitable guide rods 54, movable contact arms 60, and U-shaped contact elements 66. Complementary base sections 34 and 38 are then joined to align the guide rods and respective U-shaped contact elements into biased contact. A switch actuator 12 is then provided for each of the guide rods 54 by inserting the guide rod through the aperture 85 provided in the switch actuator 12 and finally a cover 22 is affixed to the base sections with each of the switch actuators 12 projecting through a slot 32 in the cover.

In a device built in accord with the present invention, the terminal sections of each of the base sections were on 0.100 inch centers and the spacing between opposed terminal sections was 0.300 inches. The distance from the bottom of the base to the top of the cover measured 0.280 inches and the distance from the bottom of the base to the top of the operating knob of the switch actuators measured 0.320 inches. The degree of travel of each of the switch actuators within the slot provided in the top of the cover was 0.080 inches travel. The width of the device measured 0.380 inches and the length of a four contact pair switch assembly measured 0.480 inches. The guide rods were elevated above the top surface of the base approximately 0.105 inches.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. In a slide switch, the combination of a cover having a plurality of side walls and a top wall provided with a slot, a base having first and second base sections secured to the cover, the walls of the cover and the base defining a cavity, a flexible guide means cantilevered within the cavity, a first intermediate member extending perpendicular from one end of the guide means and embedded in the first base section, a terminal integral with the first intermediate member, a movable contact arm disposed within the cavity, a U-shaped contact element integral with one end of the movable contact arm, a second intermediate member extending perpendicular from the other end of the movable contact arm and embedded in the second base section, a terminal integral with the second intermediate member, the U-shaped contact element being biased into engagement with the guide means, an actuator in slideable engagement with the flexible guide means, the actuator comprising a pair of side walls, a bight portion connecting the side walls, a cam disposed between the side walls, and an operating arm integral with the bight portion and extending through the slot in the top wall of the cover, said cam, bight portion and side walls of the actuator defining an opening, the flexible guide means being disposed within the opening, said U-shaped contact element and the movable contact arm being movable with respect to the flexible guide means for aligning the actuator with respect to the contact element and the movable contact arm whereby movement of the actuator moves the cam in an interference path with respect to the U-shaped contact element.

2. The switch of claim 1 wherein the guide means is a rod supporting the actuator for rectilinear movement along the rod.

3. A switch comprising a housing provided with a plurality of walls defining a cavity, a plurality of conductive flexible guide rods disposed within the cavity within the housing, a plurality of first terminals integral with the flexible guide rods and supported by the housing, a plurality of contacts disposed within the cavity, each of the contacts being in alignment with respect to one of the guide rods, a plurality of second terminals integral with the contacts and supported by the housing, a plurality of actuators mounted in the housing, each of the actuators being supported for movement by one of the guide rods with respect to the contact in alignment with the guide rod, and an insulative cam connected to each of the actuators and disposed in an interference path with the contact for moving the contact from a first to a second position.

4. The switch of claim 3, wherein the plurality of contacts are disposed in a line within the cavity, the plurality of guide rods are disposed in a line within the cavity, each of the contacts is biased into electrical contact with the respective guide rod, and the respective cam is interposed between the contact and the guide rod while in one of the positions.

5. The switch of claim 4, wherein the housing comprises a base, the first terminals are secured to the base in a line, the second terminals are secured to the base in a line in opposing relationship to the first terminals, a pair of spaced side walls integral with each of the actuators, each of the cams is disposed between one of the pair of side walls, the actuators are disposed side by side longitudinally with respect to the housing, and each of the actuators are supported for lateral movement with respect to the housing.

6. A switch comprising a housing provided with a plurality of walls defining a cavity, an electrically conductive guide rod disposed within the cavity within the housing and providing a first contact, a first terminal integral with the guide rod and supported by the housing, a movable contact arm disposed within the cavity, a second terminal integral with one end of the movable contact arm and supported by the housing, a contact element connected to the other end of the movable contact arm, said contact element being biased into electrical contact with the guide rod, an actuator supported for movement by the guide rod, and an insulative cam integral with the actuator, said cam being interposed between the contact element and the guide rod upon a predetermined movement of the actuator.

7. The switch of claim 6, wherein the actuator comprises a bight portion, first and second spaced side walls depend from the bight portion, the cam is disposed between the side walls and is spaced from the bight portion, the bight portion and the side walls and the cam defining an opening, and the guide rod is disposed within the opening and supports the actuator for rectilinear movement therealong.

8. The switch of claim 7, wherein one of the walls of the housing defines a base, said first and second terminals extend through the base, and said movable contact arm and the guide rod are suspended above the base and between the side walls.

9. The switch of claim 6, wherein one of the walls has a first section and a second section, the first terminal is embedded in the first section and the second terminal is embedded in the second section, the first section is joined to the second section, and the contact element is aligned with the guide rod.

10. The switch of claim 9, wherein the guide rod overlies the contact element, and the cam has a bottom surface and a cam surface whereby the cam surface engages the contact element during said predetermined movement of the actuator driving the contact element into abuttment with the bottom surface of the cam.

11. A slide switch comprising a housing having a plurality of walls, a plurality of spaced pairs of aligned overlapping contact arms disposed within the housing, a plurality of actuators, each of the actuators being movable longitudinally relative to a respective pair of contact arms, each of the actuators comprising an actuating portion disposed in an aperture provided in the housing and a pair of spaced side walls encompassing the associated pair of contact arms on either side and aligning the arms with one another and with the actuator, each pair of side walls extending beyond the pair of contact arms and partitioning the pairs of contact arms from one another within the housing, and terminal means connected to the contact arms.

12. The electrical switch of claim 11, wherein an insulative cam is disposed between each pair of side walls and in an interference path with one of the contact arms of each respective pair of contact arms, the other of the contact arms of each respective pair of contact arms is a guide rod, and each of the actuators is supported by the respective guide rod for rectilinear movement along said guide rod.

13. In a slide switch, the combination of a first base section, a plurality of electrically spaced conductive guide rods embedded in the first base section, a second base section, a plurality of electrically spaced conductive contact arms embedded in the second base section, means interlocking the first and the second base sections together and aligning each of the guide rods in overlapping relationship with each of the contact arms, a housing secured to the first and second base sections, and a plurality of actuators mounted in the housing and operable outwardly from the housing, each of the actuators comprising a cam whereby upon a predetermined movement of the actuator, the cam effects a predetermined relationship between a respective one of the guide rods and the contact arms aligned therewith.

* * * * *